US011787035B2

(12) United States Patent
Seiz et al.

(10) Patent No.: US 11,787,035 B2
(45) Date of Patent: Oct. 17, 2023

(54) HOUSING

(71) Applicant: Andreas Stihl AG & Co. KG, Waiblingen (DE)

(72) Inventors: Jonathan Seiz, Stuttgart (DE); Markus Oesterle, Althütte (DE); Thomas Haag, Erdmannhausen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 210 days.

(21) Appl. No.: 17/308,326

(22) Filed: May 5, 2021

(65) Prior Publication Data

US 2021/0379752 A1 Dec. 9, 2021

(30) Foreign Application Priority Data

Jun. 9, 2020 (EP) ..... 20178898

(51) Int. Cl.
*B25F 5/02* (2006.01)
*E01H 1/08* (2006.01)

(52) U.S. Cl.
CPC ..... *B25F 5/02* (2013.01); *E01H 1/0809* (2013.01)

(58) Field of Classification Search
CPC ..... B25F 5/02
See application file for complete search history.

(56) References Cited

U.S. PATENT DOCUMENTS 4,573,234 A * 3/1986 Kochte ..... A47L 5/24 320/124
4,637,588 A * 1/1987 Wilhelm ..... F16L 55/136 277/921
5,565,719 A * 10/1996 Kuhlmann ..... F16B 19/1081 310/47
5,595,532 A * 1/1997 McCracken ..... B25F 5/02 451/357
5,615,970 A * 4/1997 Reekie ..... A01D 34/90 56/DIG. 18
5,881,823 A * 3/1999 Kabatnik ..... B25D 17/00 173/217

(Continued)

FOREIGN PATENT DOCUMENTS

CN 205 238 195 5/2016
DE 10 2017 101 992 8/2017

(Continued)

*Primary Examiner* — Nathaniel C Chukwurah
*Assistant Examiner* — Lucas E. A. Palmer
(74) *Attorney, Agent, or Firm* — Gudrun E. Huckett

(57) ABSTRACT

A housing for a work implement has a first housing shell with first outer wall and a second housing shell with second outer wall. The first and second outer walls contact each other along a separation plane. The first housing shell has a first rib extending transversely to the separation plane and projecting past the separation plane into the second housing shell. First measuring points are located in the separation plane. The first rib has a first rib height measured in transverse direction from a first measuring point to a first end of the first rib facing the second housing shell. The second housing shell has a second shell height measured in transverse direction from the same first measuring point to an inner side of the second housing shell. The first measuring points include measuring points where the first rib height is at least 15% of the second shell height.

15 Claims, 11 Drawing Sheets

(56) References Cited

U.S. PATENT DOCUMENTS

| | | | | |
|---|---|---|---|---|
| 6,393,701 | B1 * | 5/2002 | Fuchs | B23D 49/11 30/392 |
| 11,472,017 | B2 * | 10/2022 | Shangguan | H02K 11/28 |
| 11,491,633 | B2 * | 11/2022 | Cerfeuillet | F21V 23/0442 |
| 2004/0148789 | A1 * | 8/2004 | Gist | B25F 5/02 30/392 |
| 2004/0211775 | A1 * | 10/2004 | Wehner | B01D 27/08 220/4.21 |
| 2008/0053676 | A1 * | 3/2008 | Baumann | B25F 5/02 173/217 |
| 2015/0104250 | A1 * | 4/2015 | Tada | H01M 50/247 403/375 |
| 2015/0263592 | A1 * | 9/2015 | Kawakami | B25F 5/008 451/359 |
| 2016/0199962 | A1 * | 7/2016 | Tan | B25F 5/02 451/344 |
| 2017/0225316 | A1 * | 8/2017 | Iwakami | B25F 5/02 |
| 2018/0283508 | A1 * | 10/2018 | Aoki | F16H 21/40 |
| 2019/0061132 | A1 * | 2/2019 | Mori | B25F 5/026 |
| 2019/0381649 | A1 * | 12/2019 | Peng | B27B 17/00 |
| 2021/0060754 | A1 * | 3/2021 | Tadokoro | B25F 5/008 |
| 2021/0379752 | A1 * | 12/2021 | Seiz | B25F 5/02 |
| 2022/0088763 | A1 * | 3/2022 | Bathke | B25F 5/026 |

FOREIGN PATENT DOCUMENTS

| | | |
|---|---|---|
| EP | 2 384 860 | 11/2011 |
| JP | 2008 080421 | 4/2008 |
| WO | 2018/137127 | 8/2018 |

* cited by examiner

Fig. 7
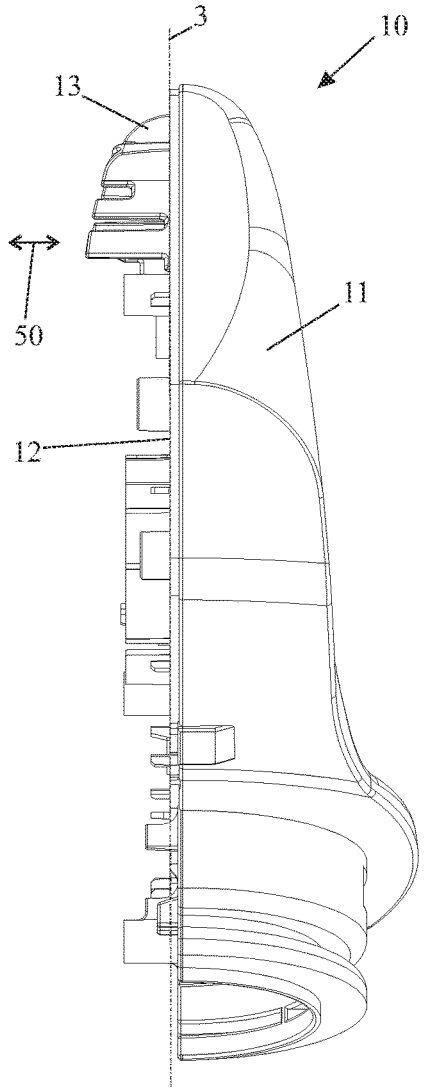
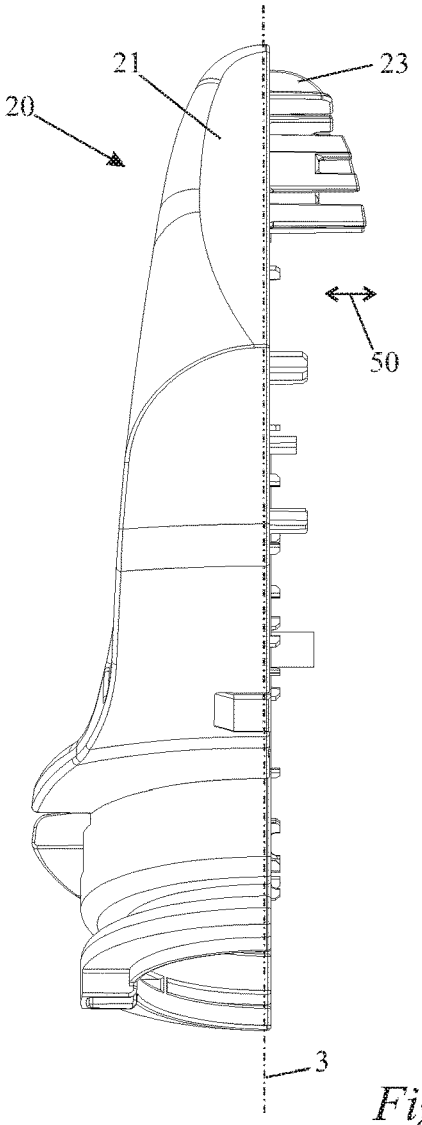
Fig. 8

HOUSING

BACKGROUND OF THE INVENTION

The invention concerns a housing for a hand-guided work implement, comprising two housing shells, namely a first housing shell and a second housing shell, wherein the first housing shell comprises a first outer wall, wherein the second housing shell comprises a second outer wall, wherein the first outer wall and the second outer wall are at least partially contacting each other along a separation plane, wherein the first housing shell comprises at least a first rib, wherein the first rib extends in a transverse direction transversely, in particular perpendicularly, to the separation plane.

DE 10 2017 101 992 A1 discloses in hand-guided work implement with two housing halves. One housing half comprises at its outer wall a rib which is introduced by means of press fit into a groove of the outer wall of the other housing half. In this way, a separation resistance between the two housing halves is produced. Such housings can become damaged, in particular when dropping from hip level.

The invention has the object to further develop a housing of the aforementioned kind in such a way that it is of a stable embodiment.

SUMMARY OF THE INVENTION

This object is solved by a housing characterized in that the first rib projects past the separation plane into the second housing shell, in that the first rib comprises a first rib height measured in transverse direction, beginning at a first measuring point in the separation plane, to a first end of the first rib facing the second housing shell, in that the second housing shell comprises a second shell height measured in transverse direction, beginning at the same first measuring point in the separation plane, to a second inner side of the second housing shell facing the first housing shell, and in that at least a first measuring point exists in the separation plane at which the first rib height amounts to at least 15%, in particular at least 30%, in particular at least 45%, preferably at least 60%, of the second shell height.

According to the invention, it is provided that the first rib projects past the separation plane into the second housing shell. In the separation plane, there exist numerous first measuring points based on which the second shell height can be determined. According to the invention, in the separation plane at least one first measuring point is present at which the first rib height amounts to at least 15%, in particular at least 30%, in particular at least 45%, preferably at least 60%, of the second shell height. In this way, there is the possibility provided that the first rib is supported at contours of the second housing shell and, in this way, can provide for a higher break strength of the housing.

It can also be provided that a plurality of first measuring points exist in the separation plane at which the first rib height amounts to at least 15%, in particular at least 30%, in particular at least 45%, preferably at least 60%, of the second shell height.

Expediently, the second housing shell comprises a second rib that extends in transverse direction and projects past the separation plane into the first housing shell. The second rib comprises a second rib height measured in transverse direction beginning at a second measuring point in the separation plane to a second end of the second rib which is facing the first housing shell. The first housing shell comprises a first shell height measured in transverse direction beginning at the same second measuring point of the separation plane to a first inner side of the first housing shell which is facing the second housing shell. Advantageously, at least one second measuring point exists in the separation plane at which the second rib height amounts to at least 15%, in particular at least 30%, in particular at least 45%, preferably at least 60%, of the first shell height. In this way, the second rib can be supported at contours of the first housing shell or at the first rib of the first housing shell and in this way can provide for a higher break strength of the housing.

The first rib comprises a first maximum wall thickness measured perpendicularly to the transverse direction in a wall thickness direction. Advantageously, a rib distance measured in wall thickness direction between the first rib and the second rib amounts to less than the first maximum wall thickness, in particular less than two thirds of the first maximum wall thickness. Upon a deformation of the housing shells, the first rib and the second rib can support each other. A deformation of the housing shells can occur upon impact of the housing after dropping from a certain height. Due to the minimal distance of the ribs relative to each other, the break strength of the housing are increased. The stability and load capacity of the housing as a whole is increased. The housing is reinforced in the region in which the rib distance amounts to less than the first maximum wall thickness, in particular less than two thirds of the first maximum wall thickness. The reinforcement is achieved by the interaction of the first and the second ribs. This provides the advantage that the structures of the individual housing shells in comparison to housings with thicker ribs can be designed more finely. In addition, it is possible to provide overall a more coarse mesh configuration of rib structures of an individual housing shell for the same reinforcement level of the housing. When producing the housing of plastic material by a demolding method, the shapes can be more simply designed and produced in this way.

Thicker ribs in only one of the housing shells would also lead to a greater reinforcement. In housings of plastic materials, thicker ribs would have the further disadvantage that, opposite to the base of the rib, visually unpleasant depression locations may appear on the outer side of the first housing wall. This can be avoided by a reinforcement of the housing by first and second ribs with a rib distance of less than the first maximum wall thickness, in particular of less than two thirds of the first maximum wall thickness. This provides for a pleasing visual design while providing at the same time high stability and strength of the housing.

Moreover, a reinforcement can be achieved in a simple manner by the rib distance of less than the first maximum wall thickness, in particular of less than two thirds of the first maximum wall thickness, in particular in comparison to the use of a separate reinforcement component that is introduced between the two housing shells.

Advantageously, the rib distance amounts to at least 1%, in particular at least 5%, of the first maximum wall thickness. In this way, it is ensured that for an external deformation of the housing, for example, during an impact, the first rib and the second rib come to rest against each other and energy can be transmitted from one to the other rib.

Expediently, the rib distance is substantially constant.

Advantageously, a wall thickness of the first rib measured in wall thickness direction deviates by less than 10% from the first maximum wall thickness in transverse direction.

In particular, the first rib extends on both sides of the separation plane.

In an advantageous further embodiment of the invention, it is provided that the first rib comprises at least a first region that is arranged in relation to the second outer wall at a first distance measured in the separation plane perpendicularly to the second outer wall. In this way, an increase of stability of the housing is provided also in the region that is spaced apart from the outer wall.

Expediently, the first rib is fixed at the first outer wall. In particular, the first rib is fixed in transverse direction with its first rib base at the first outer wall. In this way, forces can be transmitted between the first outer wall and the first rib.

In particular, the first rib is embodied monolithic with the first outer wall. In this way, a stable connection between the first rib and the first outer wall is produced.

In an advantageous further embodiment of the invention, it is provided that the first rib comprises a first shell distance in relation to the second housing shell measured in transverse direction and that the first shell distance is greater than 40% of the first maximum wall thickness of the first rib. In this way, the housing can be designed such that the first rib and the second rib overlap across a large region in relation to the transverse direction. A support of the first rib is realized in this way near a second rib base of the second rib so that forces can be easily absorbed and transmitted.

In an advantageous further embodiment of the invention, the first housing shell comprises at least two first ribs. Expediently, the at least two first ribs, viewed in transverse direction, have a crossing point. Due to the first ribs crossing each other, a stable structure is provided which increases the stability of the housing. In particular, the crossing point, viewed in transverse direction, comprises a first cross distance to the first housing wall. Expediently, the at least two first ribs, viewed in transverse direction, extend, beginning at the crossing point, to the first housing wall. In this way, forces can be transmitted between the crossing point and the first housing wall. The at least two first ribs can contribute in regard to absorption of forces across the crossing point. In this way, the forces are distributed more uniformly and can be absorbed by the housing more easily without being damaged.

Expediently, the first housing shell comprises a plurality of first ribs. In particular, the second housing shell comprises a plurality of second ribs.

The plurality of first ribs and the plurality of second ribs comprise a total length which is measured and added up in the separation plane. The plurality of first ribs and the plurality of second ribs are delimited in the separation plane by an enveloping polygon. The corner points of the polygon are positioned on end points of the plurality of first ribs and of the plurality of second ribs in the separation plane. The polygon comprises a polygon surface. In an advantageous further embodiment of the invention, it is provided that the quotient of the total length of the plurality of first ribs and of the plurality of second ribs and the polygon surface amounts to at least 0.2 $mm^{-1}$. In this way, a satisfactory large rib density results for a high stability of the housing.

Expediently, the first rib comprises a first cutout. In particular, the second housing shell comprises a second reinforcement rib. The second reinforcement rib extends, beginning at the second housing wall, in transverse direction in the direction toward the first housing shell. In particular, the second reinforcement ribs extends exclusively on one side of the separation plane. However, it can also be provided that the second reinforcement rib is a second rib of the second housing shell and projects past the separation plane into the first housing shell. Advantageously, the second reinforcement rib projects in transverse direction into the first cutout of the first rib. In particular, the second reinforcement rib crosses the cutout of the first rib in a direction perpendicular to the transverse direction. Upon a deformation of the housing, the first rib of the first housing shell and the second reinforcement rib of the second housing shell can be supported on each other and forces can be transmitted between them. This also increases the stability.

In an advantageous further embodiment of the invention, it is provided that at least a part of the plurality of first ribs, viewed in transverse direction, form of a closed structure circumferentially extending about the transverse direction. Due to the closed structure, the plurality of first ribs of the second part of the plurality of first ribs can transmit forces among each other. The stability of the housing is increased in this way.

Expediently, the first housing shell and the second housing shell are injection molded parts.

In particular, the housing is a grip housing. Expediently, an operating element for operating the work implement is arranged at the grip housing.

In an advantageous further embodiment of the invention, it is provided that the first rib intersects the separation plane across an added-up first length and that the first rib across at least half of the added-up first length comprises first measuring points at which the first rib height amounts to at least 15%, in particular at least 30%, in particular at least 45%, preferably at least 60%, of the correlated second shell height. In this way, the first rib, upon deformation of the housing during an impact, can be supported across a large portion of its first length in the separation plane in the second housing shell. In particular, it can be provided that the rib distance between the first rib of the first housing shell and the second rib of the second housing shell across at least half of the added-up first length of the first rib amounts to less than the first maximum wall thickness of the first rib, in particular less than two thirds of the first maximum wall thickness of the first rib. Moreover, it can be provided that the second rib intersects the separation plane across an added-up second length and that the second rib across at least half of the added-up second length has first measuring points at which the second rib height amounts to at least 15%, in particular at least 30%, in particular at least 45%, preferably at least 60%, of the correlated second shell height.

BRIEF DESCRIPTION OF THE DRAWINGS

An embodiment of the invention will be explained in the following with the aid of the drawing. It is shown in:

FIG. 7 a side view of the first housing shell of FIG. 3 perpendicular to the transverse direction;

FIG. 8 a side view of the second housing shell of FIG. 4 perpendicular to the transverse direction;

DESCRIPTION OF PREFERRED EMBODIMENTS

Figure 1:
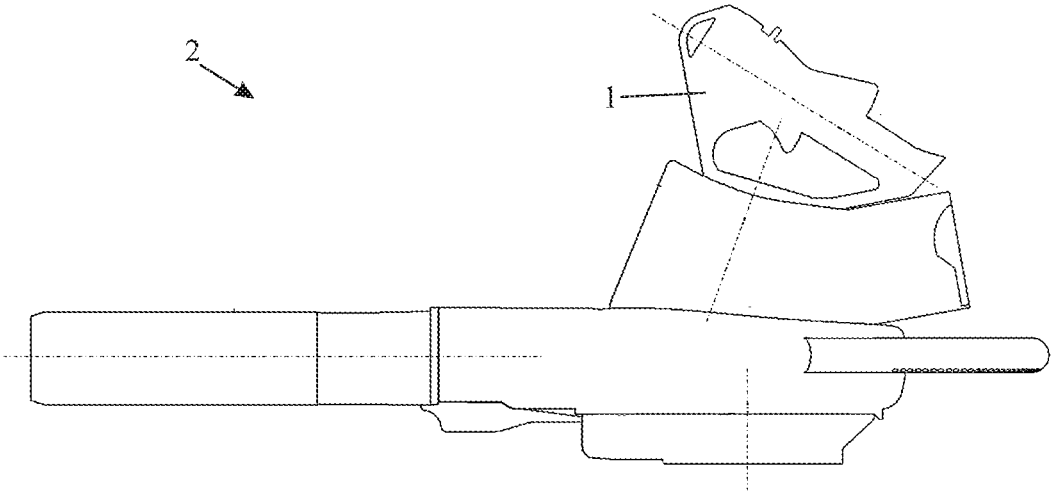
FIG. 1 a schematic side view of a work implement with a housing.

FIG. 1 shows a hand-guided work implement 2. The hand-guided work implement 2 is a blower. However, the work implement can also be, for example, a motor chainsaw, a trimmer, a cutoff machine or the like.

The work implement 2 comprises a housing 1. In the embodiment, the housing 1 is a grip housing. The housing can however also be any other type of housing, for example, a motor housing or the like.

Figure 2:
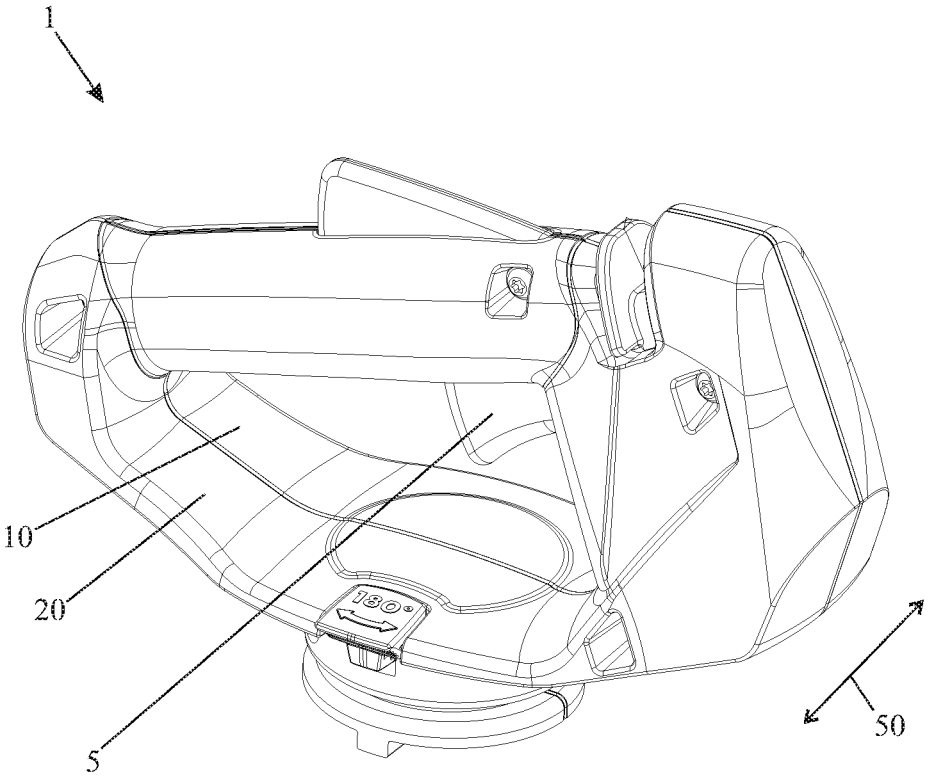
FIG. 2 a perspective illustration of a housing.

As illustrated in FIG. 2, the work implement 2 comprises an operating element 5. In the embodiment, the operating element 5 is a throttle lever. By means of the operating element 5, a motor, not illustrated, of the work implement 2 can be operated. The operating element 5 projects from the housing 1.

The housing 1 comprises a first housing shell 10 and a second housing shell 20. The operating element 5 is arranged between the first housing shell 10 and the second housing shell 20.

The first housing shell 10 and the second housing shell 20 each are produced by a demolding method. The first housing shell 10 and the second housing shell 20 are made of plastic material. In the embodiment, the first housing shell 10 and the second housing shell 20 each are each produced by an injection molding method. The first housing shell 10 and the second housing shell 20 are injection molded parts. In FIG. 2, a transverse direction 50 is illustrated. When assembling the housing 1, the first housing part 10 and the second housing part 20 are caused to approach in transverse direction 50 so that they contact each other. The transverse direction 50 points in two opposite directions. The transverse direction 50 corresponds to the demolding direction for demolding the first housing shell 10. The transverse direction 50 corresponds to the demolding direction for demolding the second housing shell 20. Demolding direction refers to the direction in which the molds for the respective housing shells 10, 20 are to be removed upon demolding. This means the normal demolding direction. The demolding direction of gates for forming undercuts is not referred to by the term demolding direction.

Figure 3:
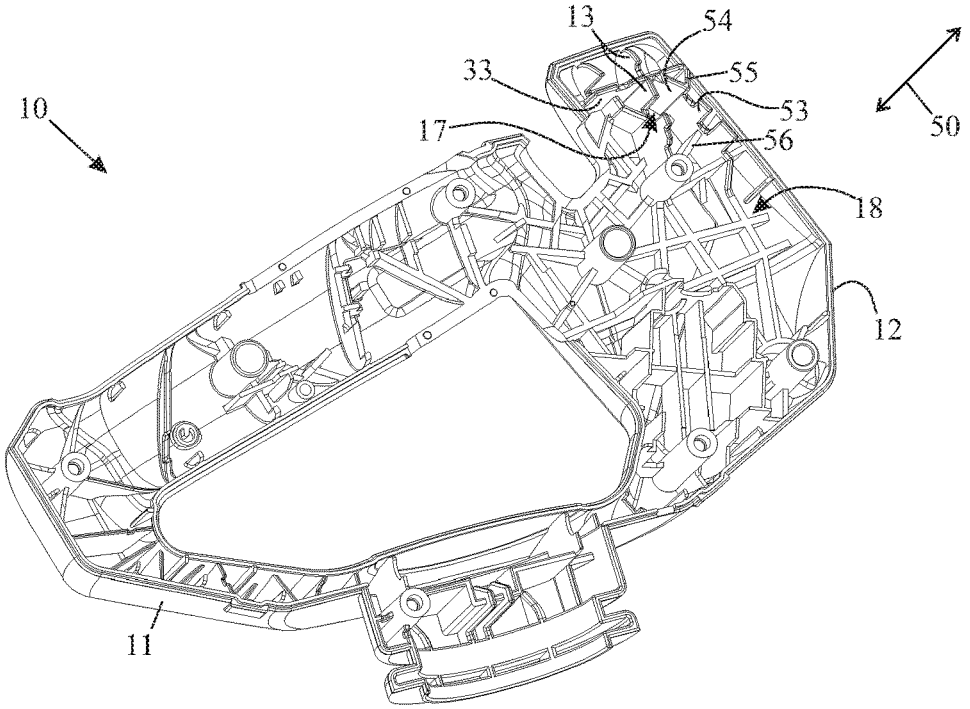
FIG. 3 a perspective illustration of a first housing shell of the housing according to FIG. 2 with a view of an inner side of the first housing shell.

FIG. 3 shows the first housing shell 10 in a perspective view. The first housing shell 10 comprises a first inner side 18 which is facing the second housing shell 20 in the assembled state of the housing 1. The first inner side 18 is delimited at least partially by a first outer wall 11. The first outer wall 11 forms a part of an outer side of the housing 1. The first outer wall 11 comprises a first end face 12. In the assembled state of the housing 1, the first end face 12 is facing the second housing shell 20. The first housing shell 10 is positioned with its first end face 12 at the second housing shell 20. The first end face 12 extends in the embodiment at least partially perpendicularly to the transverse direction 50.

Figure 4:
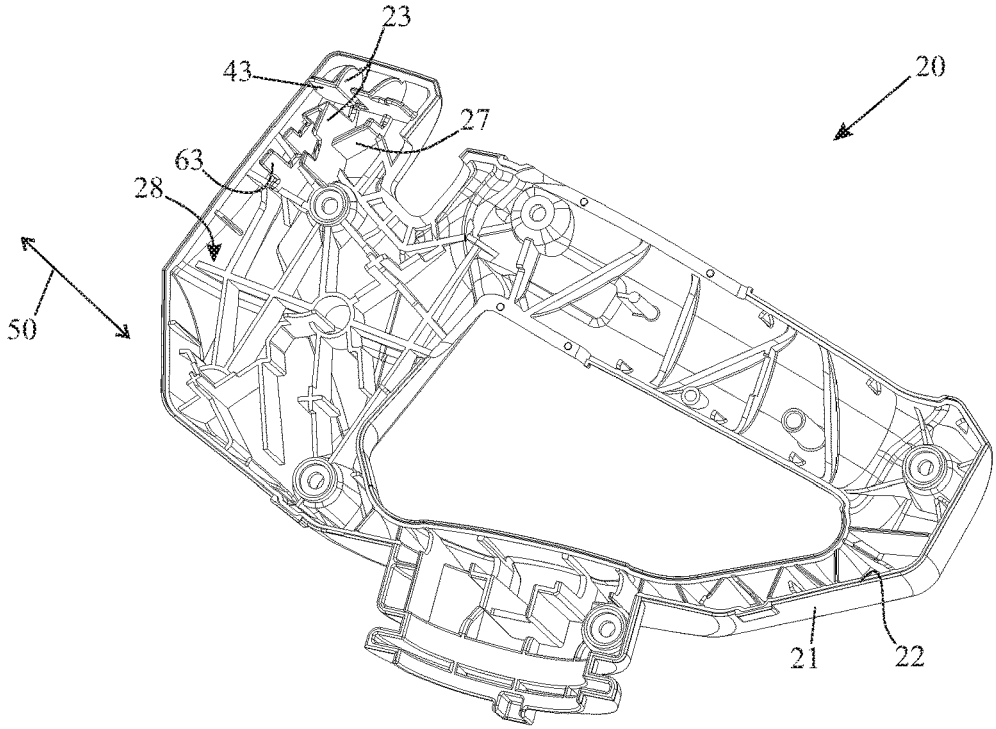
FIG. 4 a perspective illustration of a second housing shell of the housing according to FIG. 2 with a view of an inner side of the second housing shell.

FIG. 4 shows the second housing shell 20. The second housing shell 20 comprises a second inner side 28 which is facing the first housing shell 10 in the assembled state of the housing 1. The second inner side 28 is at least partially delimited by a second outer wall 21. The second outer wall 21 forms a portion of an outer side of the housing 1. The second outer wall 21 comprises a second end face 22. In the assembled state of the housing 1, the second end face 22 is facing the first housing shell 10. The second housing shell 20 is contacting with its second end face 22 the first housing shell 10. In the embodiment, the second end face 22 extends at least partially perpendicularly to the transverse direction 50.

The first outer wall 11 and the second outer wall 21 from an outer side of the housing 1. The term outer wall excludes transverse stays in the interior of the housing 1.

Figure 13:
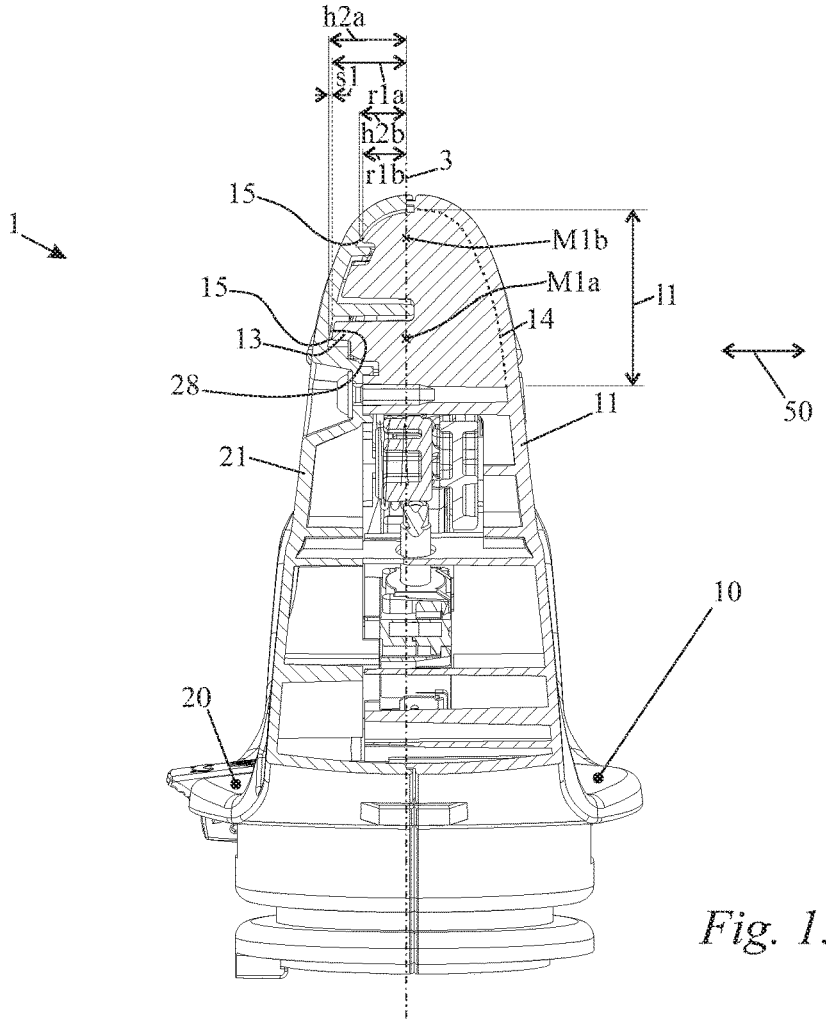
FIG. 13 a section along the section plane XIII-XIII of FIG. 12.
Figure 14:
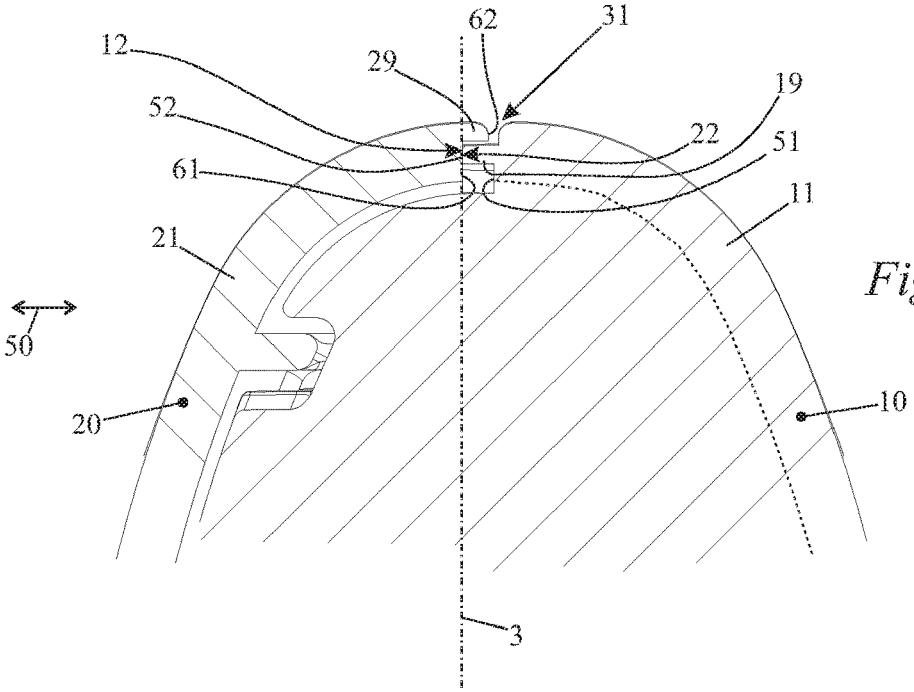
FIG. 14 a detail of the section illustration of FIG. 13.
Figure 15:
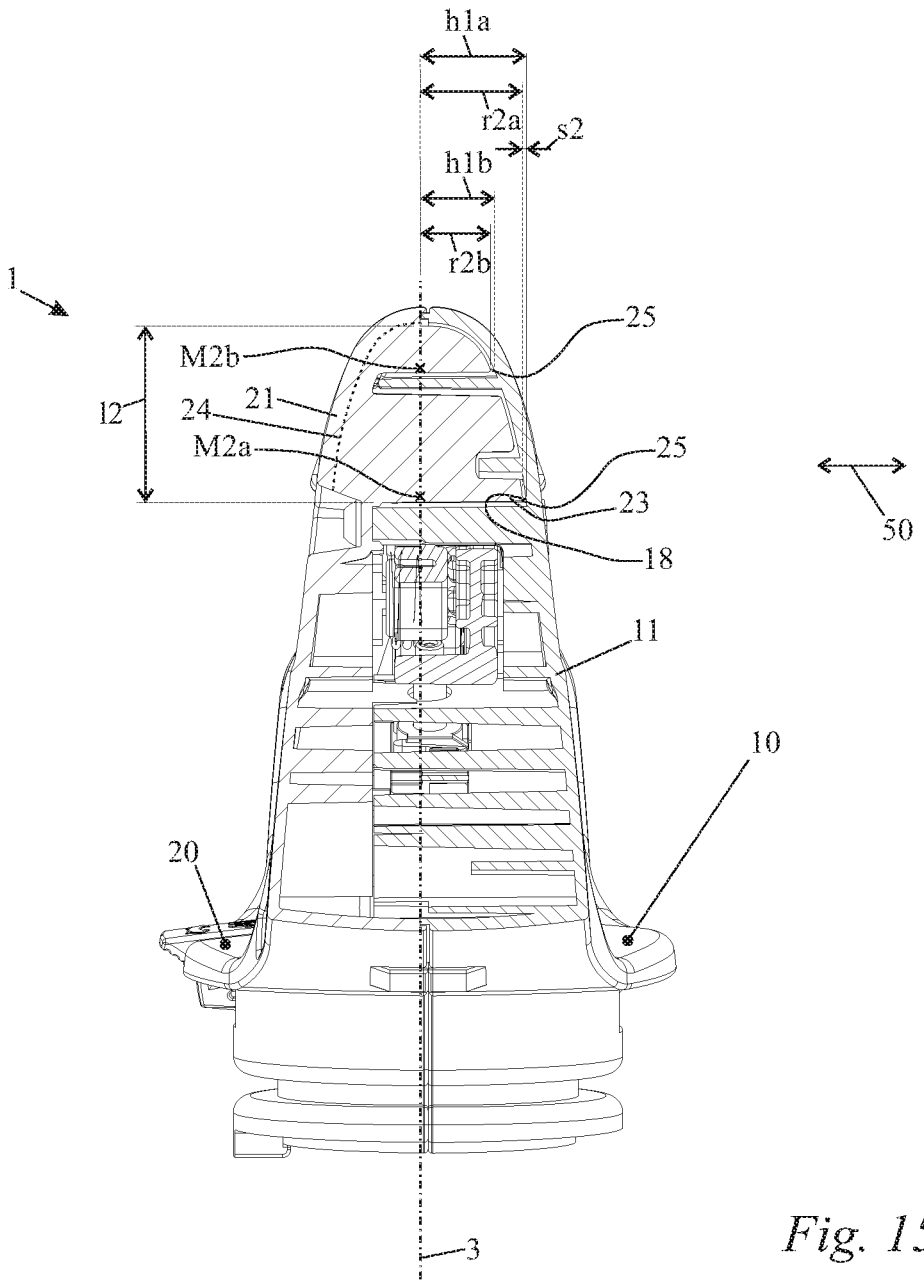
FIG. 15 a section along the section plane XV-XV of FIG. 12.

The housing shells 10 and 20 resting against each other are illustrated in particular in the FIGS. 13 to 15. When looking at FIGS. 3, 4 and 13 or 14 jointly, it can be seen that the first outer wall 11 of the first housing shell 10 and the second outer wall 21 of the second housing shell 20 are at least partially contacting each other along the separation plane 3. In the separation plane 3, the first housing shell 10 and the second housing shell 20 contact each other. The separation plane 3 extends transversely to the transverse direction 50. In the embodiment, the separation plane 3 extends perpendicularly to the transverse direction 50. In the separation plane 3, the first housing shell 10 and the second housing shell 20 contact each other in transverse direction 50.

As illustrated in FIG. 14, the first end face 12 of the first outer wall 11 comprises a first projection 19. The second end face 22 of the second outer wall 21 comprises a second projection 29. The first projection 19 projects in transverse direction 50 in the direction toward the second housing shell 20 past a first end face base 51 of the first end face 12 (FIG. 14). The second projection 29 projects in transverse direction 50 in the direction toward the first housing shell 10 past a second end face base 61 of the second end face 22. The second projection 29 is arranged closer to an outer side of the housing 1 than the first projection 19. An outer side of the second projection 29 is part of the outer side of the housing 1. The first projection 19 corresponds with the second projection 29. The second projection 29 and the first projection 19 overlap in relation to the transverse direction 50. The second projection 29 extends around an outer side of the first projection 19 at least partially. Upon assembly of the housing 1, the first housing shell 10 and the second housing shell 20 are positioned relative to each other by means of the first projection 19 and of the second projection 29. It can be provided that an outer side of the first projection 19 contacts an inner side of the second projection 29.

In transverse direction 50, the first projection 19 is delimited by a first front face 52. The first front face 52 is facing the second housing shell 20. The first front face 52 is positioned at the second end face base 61 of the second end face 22 of the second outer wall 21. The first front face 52 and the second end face base 61 are contacting each other in the separation plane 3.

The second projection 29 projects in transverse direction 50 in the direction toward the first housing shell 10 past the separation plane 3. The second projection 29 is delimited in transverse direction 50 by a second front face 62. Between the second front face 62 of the second projection 29 and the first end face base 51 of the second end face 12 a groove 31 is formed. The groove 31 is visible at the outer side of the housing 1. A bottom of the groove 31 is formed by the first projection 19. The groove 31 extends between the first housing shell 10 and the second housing shell 20. In the embodiment, the groove 31 extends outside of the separation plane 3.

As can be seen in FIGS. 2 to 4, the first outer wall 11 and the second outer wall 21 delimit a cavity in the interior of the housing 1. In the first housing shell 10 (FIG. 3), a first rib 13 is arranged in the cavity. The first rib 13 extends beginning at the first outer wall 11 of the first housing shell 10 in transverse direction 50 in the direction toward the second housing shell 20. As can be seen also in FIGS. 7 and 9, the first rib 13 projects in transverse direction 50 past the separation plane 3. The first rib 13 projects into the second housing shell 20. The first housing shell 10 comprises a plurality of first ribs 13, 33, 53, 54, 55 as can be seen in FIG. 3. All of these first ribs 13, 33, 53, 54, and 55 project past the separation plane 3. The first rib 13, 33, 53, 54, 55 is secured at the first outer wall 11. The first rib 13 is secured with its first rib base 14 at the first outer wall 11 (FIG. 13). The first rib 13, 33, 53, 54, 55 in the embodiment is embodied monolithic with the first outer wall 11. The first rib 13, 33, 53, 54, 55 is produced by an injection molding method together with the first outer wall 11. The first rib 13, 33, 53, 54, 55 extends on both sides of the separation plane 3.

The first ribs 33, 54, and 55 form together a structure (FIG. 3) extending circumferentially closed about the transverse direction 50.

At the inner side of the first outer wall 11, a first reinforcement rib 56 is arranged. The first reinforcement rib 56 is fixed at the first outer wall 11. The first reinforcement rib 56 extends beginning at the first outer wall 11 in transverse direction 50 in the direction toward the second housing shell 20. The first reinforcement rib 56 is arranged exclusively on one side of the separation plane 3. The first reinforcement rib 56 connects advantageously the first rib 13 with the first rib 53. In the embodiment, the first ribs 13 and 53 form together with the first reinforcement rib 56 a structure extending circumferentially closed about the transverse direction 50.

Figure 10:
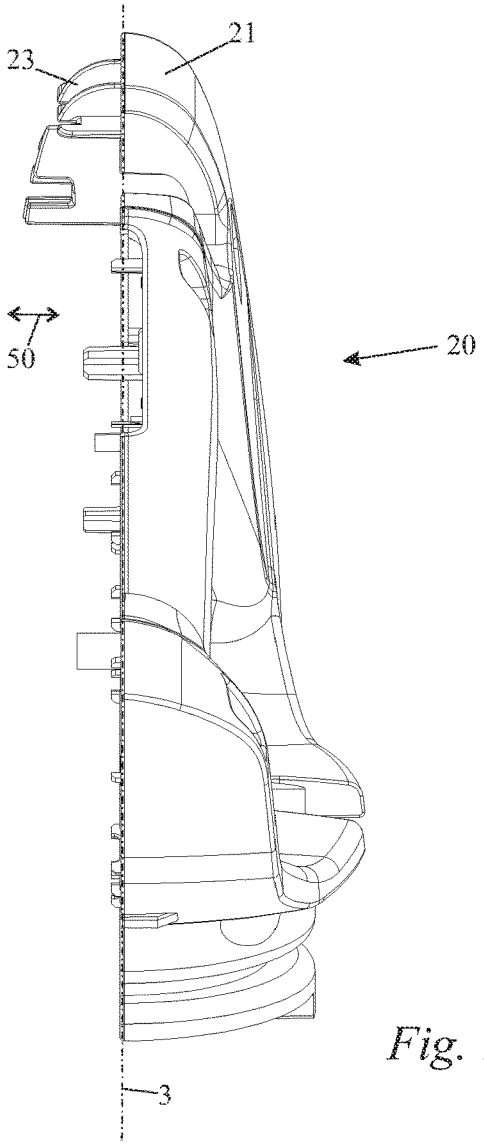
FIG. 10 a side view of the second housing shell of FIG. 4 perpendicular to the transverse direction.

FIG. 4 shows the second housing shell 20 with a view of its inner side. The second housing shell 20 comprises a second rib 23. The second rib 23 extends beginning at the second outer wall 21 of the second housing shell 20 in transverse direction 50 in the direction toward the first housing shell 10. As also illustrated in FIGS. 8 and 10, the second rib 23 projects in transverse direction 50 past the separation plane 3. The second rib 23 projects into the first housing shell 10. The second rib 23 is arranged in the cavity (FIGS. 2 to 4). The first outer wall 11 and the second outer wall 21 delimit the cavity in the interior of the housing 1. The first rib 13 as well as the second rib 23 are arranged in the cavity. The second housing shell 20 comprises a plurality of second ribs 23, 43, 63 (FIG. 4). All of the second ribs 23, 43, and 63 project past the separation plane 3. The second rib 23, 43, 63 is secured at the second outer wall 21. The second rib 23 is secured with its second rib base 24 at the second outer wall 21 (FIG. 15). The second rib 23, 43, 63 in the embodiment is embodied monolithic with the second outer wall 21. The second rib 23, 43, 63 is produced together with the second outer wall 21 by an injection molding method.

As illustrated in FIG. 4, a second reinforcement rib 27 is arranged at the inner side of the second outer wall 21. The second reinforcement rib 27 is fixed at the second outer wall 21. Beginning at the second outer wall 21, the second reinforcement rib 27 extends in transverse direction 50 in the direction toward the first housing shell 10. The second reinforcement rib 27 is arranged exclusively at one side of the separation plane 3. The second reinforcement rib 27 connects advantageously the second rib 23 with the second rib 43. In the embodiment, the second ribs 23 and 43 form together with the second reinforcement rib 27 a structure extending circumferentially closed about the transverse direction 50.

Figure 5:
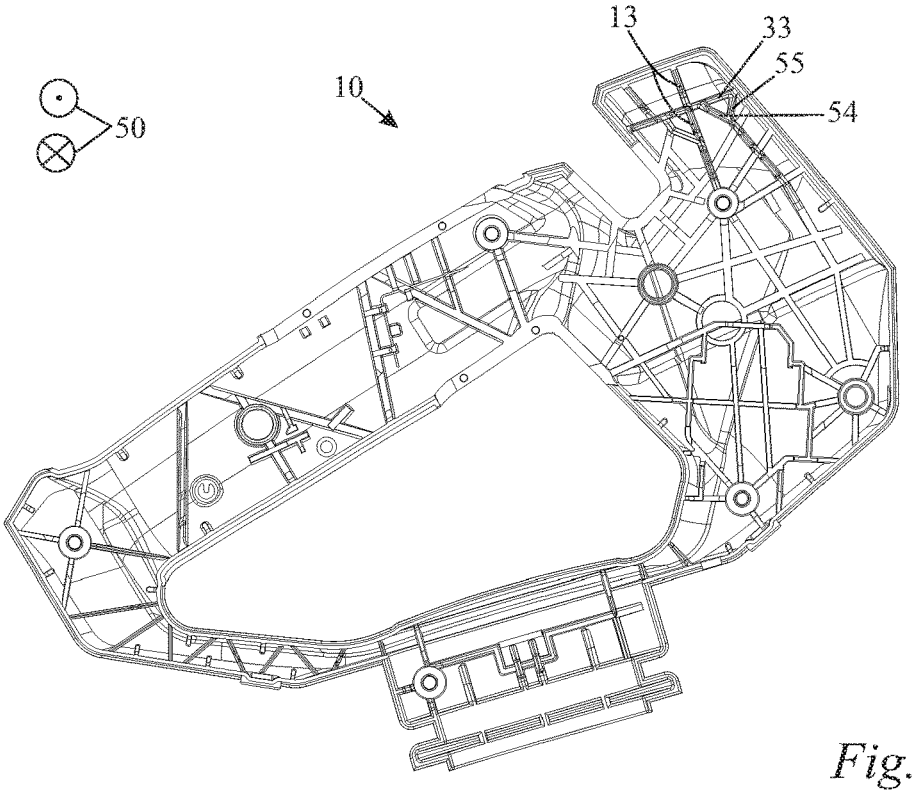
FIG. 5 a side view in a transverse direction of the inner side of the first housing shell of FIG. 3.
Figure 6:
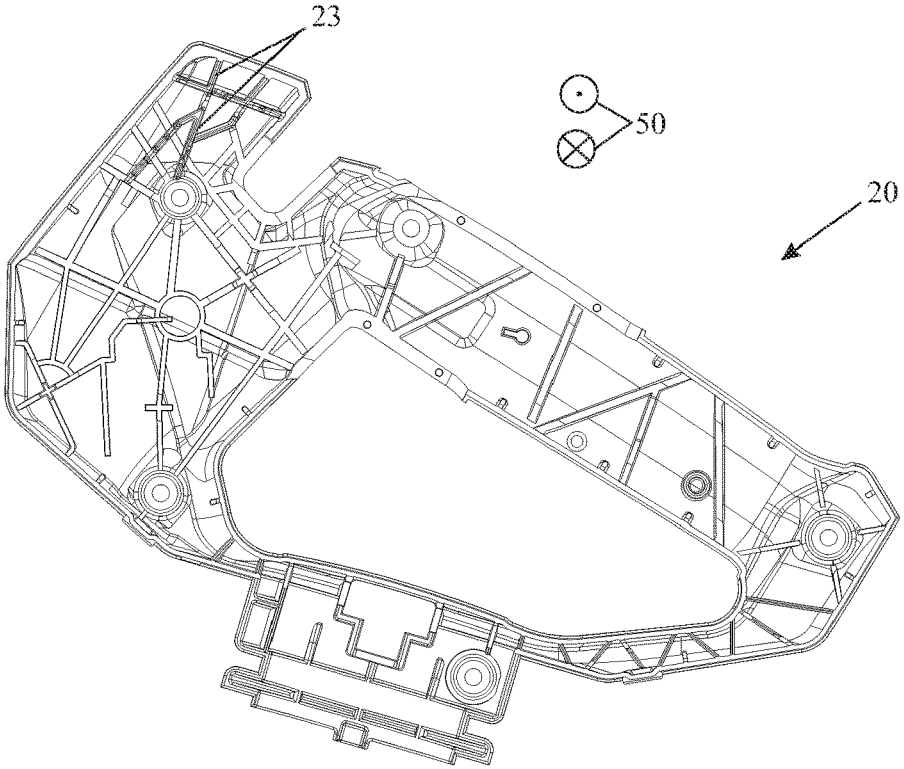
FIG. 6 a side view in transverse direction of the inner side of the second housing shell of FIG. 4.

FIG. 5 shows a side view of the inner side of the first housing shell 10 in transverse direction 50. FIG. 6 shows a side view of the inner side of the second housing shell 20 in transverse direction 50.

Figure 9:
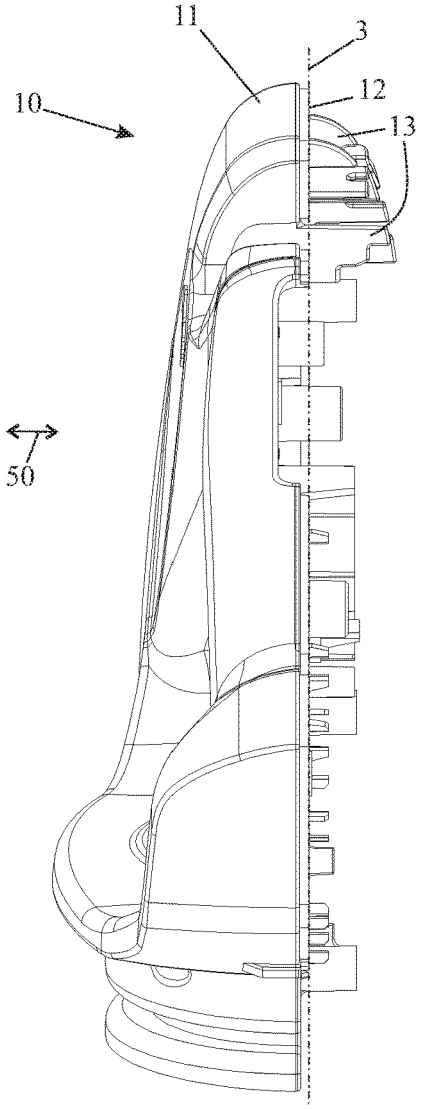
FIG. 9 a side view of the first housing shell of FIG. 3 perpendicular to the transverse direction.

FIGS. 7 to 10 show side views of the first housing shell 10 and of the second housing shell 20 in directions perpendicular to the transverse direction 50. FIGS. 7 and 9 show in particular in which shape the first rib 13 projects past the separation plane 3. FIGS. 8 and 10 show in particular in which shape the second rib 23 projects past the separation plane 3.

Figure 11:
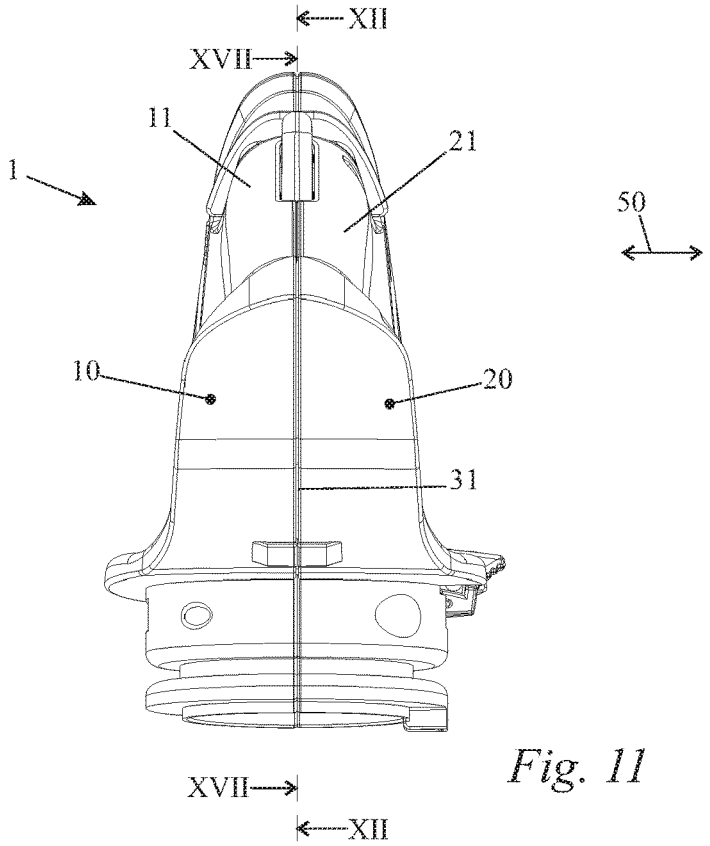
FIG. 11 a side view of the housing of FIG. 2 perpendicular to the transverse direction.

FIG. 11 shows the housing 1 in the assembled state in a side view in the direction perpendicularly to the transverse direction 50. Between the first housing shell 10 and the second housing shell 20 the groove 31 is formed.

Figure 12:
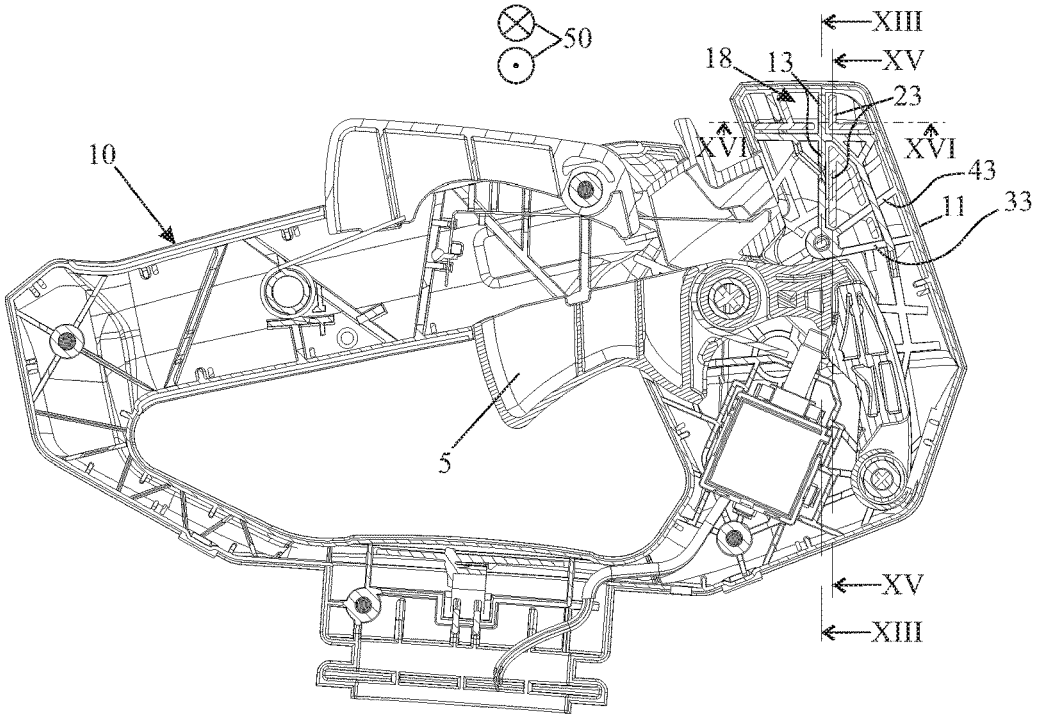
FIG. 12 a section along the section plane XII-XII of FIG. 11.

FIG. 12 shows a section through the housing 1 along the section plane XII-XII of FIG. 11. FIG. 12 shows the first inner side 18 of the first housing wall 11 of the first housing shell 10. The second rib 23 of the second housing shell 20 projects into the first housing shell 10. The first rib 13 of the first housing shell 10 and the second rib 23 of the second housing shell 20 are arranged immediately adjacent to each other. The first rib 13 of the first housing shell 10 and the second rib 23 of the second housing shell 20 extend parallel to each other in the section plane.

FIG. 13 shows a section through the housing 1 along the section plane XIII-XIII of FIG. 12. The section extends through the first rib 13 of the first housing shell 10. The transition between the first rib 13 and the first outer wall 11 is shown in dashed lines. The first rib 13 comprises a first end 15. The first end 15 is facing the second housing shell 20. The first end 15 is facing the second inner side 28 of the second housing shell 20. The first end 15 is the end face of the first rib 13. The first end 15 is the rim of the first rib 13. The first end 15 is facing in transverse direction 50.

The first rib 13 comprises a first rib height r1*a*, r1*b*. The first rib height r1*a*, r1*b* is measured from the separation plane 3 to the first end 15 of the first rib 13. The first rib height r1*a*, r1*b* is measured in transverse direction 50. The first rib height r1*a*, r1*b* is measured perpendicularly to the separation plane 3. The first rib height r1*a* is measured beginning at a first measuring point M1*a*. The first rib height r1*b* is measured beginning at a first measuring point M1*b*. The first measuring point M1*a*, M1*b* is positioned in the separation plane 3. The first measuring point M1*a*, M1*b* is positioned in a region of the separation plane 3 that is intersected by the first rib 13. The first measuring point M1*a* is spaced apart from the first measuring point M1*b*. In the embodiment, the first rib height r1*a* is larger than the first rib height r1*b*.

The second housing shell 20 comprises a second shell height h2*a*, h2*b*. The second shell height h2*a*, h2*b* is measured from the separation plane 3 to the second inner side 28 of the second housing shell 20. The second inner side 28 of the second housing shell 20 corresponds to the inner side of the second outer wall 21 of the second housing shell 20. The second shell height h2*a*, h2*b* is measured in transverse direction 50. The second shell height h2*a*, h2*b* is measured perpendicularly to the separation plane 3. The second shell height h2*a* is measured beginning at the first measuring point M1*a*. The second shell height h2*b* is measured beginning at the first measuring point M1*b*. The second shell height h2*a* is measured beginning at the same first measuring point M1*a* as the first rib height r1*a*. The second shell height h2*b* is measured beginning at the same first measuring point M1*b* as the first rib height r1*b*. In the embodiment, the second shell height h2*a* is larger than the second shell height h2*b*.

In the separation plane 3, numerous first measuring points are existing based on which the first rib height and the second shell height can be determined. In the separation plane 3, there exists at least one first measuring point M1*a*, M1*b* at which the first rib height r1*a*, r1*b* amounts to at least 15%, in particular at least 30%, in particular at least 45%, preferably at least 60%, of the second shell height h2*a*, h2*b*. In the embodiment, the first rib height r1*a* amounts to at least 60% of the second shell height h2*a*. The first rib height r1*b* amounts to at least 60% of the second shell height h2*b*.

The first rib 13 intersects the separation plane 3 across an integrated first length 11. The first rib 13 comprises across at least half of the integrated first length 11 first measuring points where the first rib height amounts to at least 15%, in particular at least 30%, in particular at least 45%, preferably at least 60%, of the correlated second shell height. In the embodiment, the first rib 13, across at least 90% of the integrated first length 11, comprises first measuring points at which the first rib height amounts to at least 15%, in particular at least 30%, in particular at least 45%, preferably at least 60%, of the correlated second shell height. However, it can also be provided that the first rib 13 comprises across the entire integrated first length 11 first measuring points at which the first rib height amounts to at least 15%, in particular at least 30%, in particular at least 45%, preferably at least 60%, of the correlated second shell height.

FIG. 15 shows a section through the housing 1 along the section plane XV-XV of FIG. 12. The section extends through the second rib 23 of the second housing shell 20. The transition between the second rib 23 and the second outer wall 21 is indicated by dashed lines. The second rib 23 comprises a second end 25. The second end 25 is facing the first housing shell 10. The second end 25 is facing the first inner side 18 of the first housing shell 10. The second end 25 is the end face of the second rib 23. The second end 25 is the rim of the second rib 23. The second end 25 is oriented in transverse direction 50.

The second rib 23 comprises a second rib height r2*a*, r2*b*. The second rib height r2*a*, r2*b* is measured from the separation plane 3 to the second end 25 of the second rib 23. The second rib height r2*a*, r2*b* is measured in transverse direction 50. The second rib height r2*a*, r2*b* is measured perpendicularly to the separation plane 3. The second rib height r2*a* is measured beginning at a second measuring point M2*a*. The second rib height r2*b* is measured beginning at a second measuring point M2*b*. The second measuring point M2*a*, M2*b* is positioned in the separation plane 3. The second measuring point M2*a*, M2*b* is located in a region of the separation plane 3 that is intersected by the second rib 23. The second measuring point M2*a* is spaced apart from the second measuring point M2*b*. In the embodiment, the second rib height r2*a* is greater than the second rib height r2*b*.

The first housing shell 10 comprises a first shell height h1*a*, h1*b*. The first shell height h1*a*, h1*b* is measured from the separation plane 3 to the first inner side 18 of the first housing shell 10. The first inner side 18 of the first housing shell 10 corresponds to the inner side of the first outer wall 11 of the first housing shell 10. The first shell height h1*a*, h1*b* is measured in transverse direction. The first shell height h1*a*, h1*b* is measured perpendicularly to the separation plane 3. The first shell height h1*a* is measured beginning at the second measuring point M2*a*. The first shell height h1*b* is measured beginning at the second measuring point M2*b*. The first shell height h1*a* is measured beginning at the same second measuring point M2*a* as the first rib height r1*a*. The second shell height h2*b* is measured beginning at the second measuring point M2*b* as the second rib height r2*b*. In the embodiment, the first shell height h1*a* is greater than the second shell height h1*b*.

In the separation plane 3, there exist numerous second measuring points based on which the second rib height and the first shell height can be determined. In the separation plane 3 at least one second measuring point M2*a*, M2*b* exists at which the second rib height r2*a*, r2*b* amounts to at least 15%, in particular at least 30%, in particular at least 45%, preferably at least 60%, of the first shell height h1*a*, h1*b*. In the embodiment, the second rib height r2*a* amounts to at least 60% of the first shell height h1*a*. The second rib height r2*b* amounts to at least 60% of the first shell height h1*b*.

The second rib 23 intersects the separation plane 3 across an integrated second length l2. The second rib 23 comprises across at least half of the integrated second length l2 second measuring points at which the second rib height amounts to at least 15%, in particular at least 30%, in particular at least 45%, preferably at least 60%, of the correlated first shell height. In the embodiment, the second rib 23 comprises across at least 90% of the integrated second length l2 second measuring points at which the second rib height amounts to at least 15%, in particular at least 30%, in particular at least 45%, preferably at least 60%, of the correlated first shell height. It can also be provided that the second rib 23 across the entire integrated second length l2 comprises second measuring points at which the second rib height amounts to at least 15%, in particular at least 30%, in particular at least 45%, preferably at least 60%, of the correlated first shell height.

In the embodiment, the first housing shell 10 and the second housing shell 20 contact each other in relation to the transverse direction 50 only in a single plane. The position of the separation plane 3 is unequivocally determined. Should the first housing shell 10 and the second housing shell 20 in transverse direction have contact points in more than one plane, the position of the separation plane is to be determined such that the separation plane is perpendicular to the demolding direction and that a first surface area of the first outer wall is of the same size as the second surface area of the second outer wall. The first surface area is the surface area of the part of an outer surface of the first outer wall which, in the direction toward the second outer wall, projects past the separation plane to be determined and contacts the second outer wall. The second surface area is the surface area of the part of an outer side of the second outer wall which, in the direction toward the first outer wall, projects past the separation plane to be determined and contacts the first outer wall.

Figure 16:
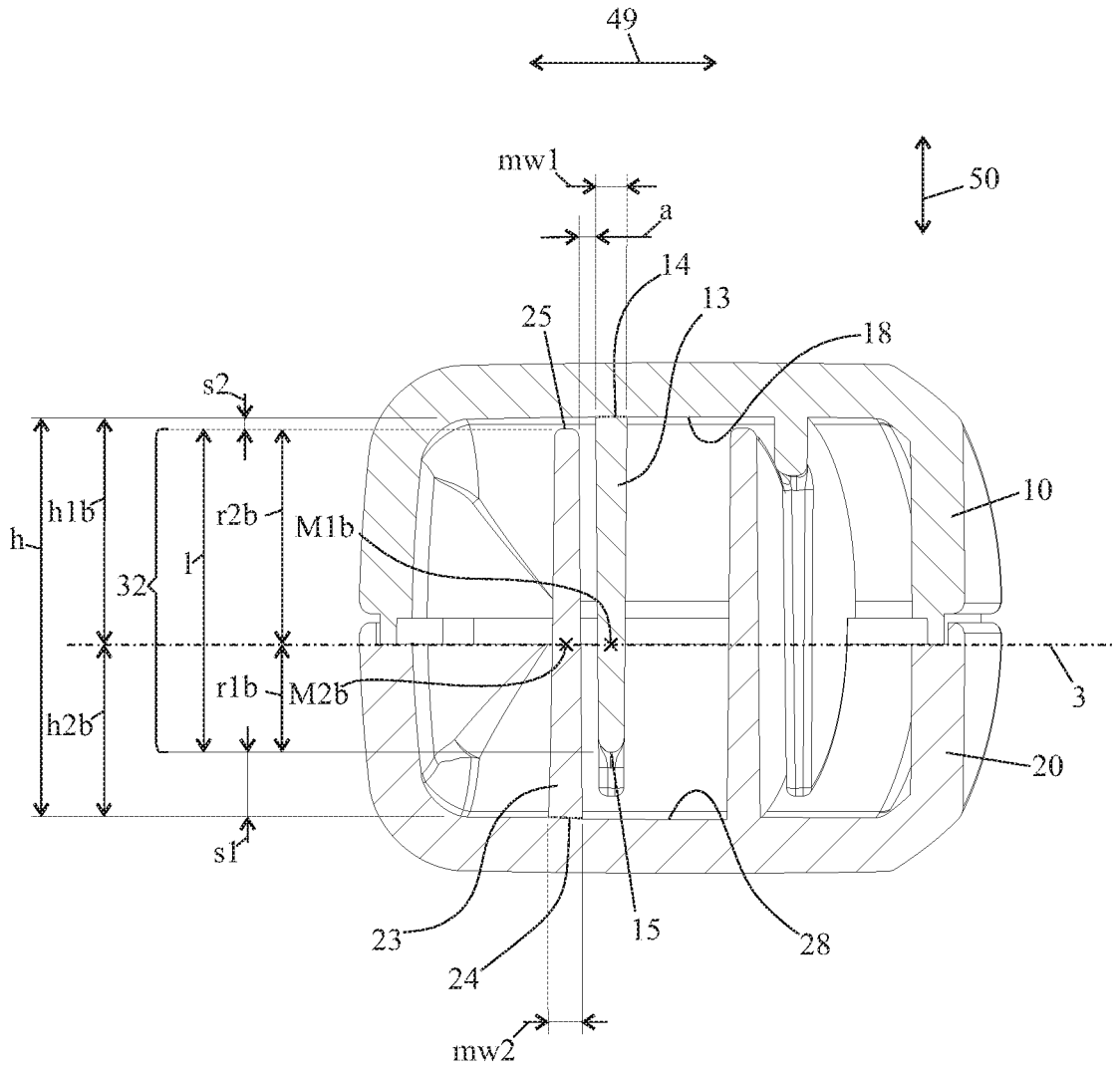
FIG. 16 a section along the section plane XVI-XVI of FIG. 12.

FIG. 16 shows a section along the section plane XVI-XVI of FIG. 12. The section plane extends perpendicularly to the separation plane 3 through the first rib 13 and through the second rib 23. The section plane extends through the first measuring point M1*b* illustrated in FIG. 13 and through the second measuring point M2*b* illustrated in FIG. 15. Correspondingly, the first housing shell 10 in the section plane according to FIG. 16 comprises the first shell height h1*b*. The second housing shell 20 comprises the second shell height h2*b*. The sum of the first shell height h1*b* and of the second shell height h2*b* provides the cavity height h of the housing 1. The cavity height h is measured in the transverse direction 50 between the first inner side 18 of the first housing shell 10 and the second inner side 28 of the second housing shell 20 at the level of the first measuring point M1*b*. The cavity height h is measured from the first groove base 14 of the first rib 13 to the second inner side 28 of the second housing shell 20.

The first rib 13 and the second rib 23 overlap each other in relation to the transverse direction 50 in an overlap region 32. The overlap region 32 comprises an overlap length l which is measured in transverse direction. The overlap length l corresponds to the sum of the first rib height r1*b* and of the second rib height r2*b*. The overlap length l amounts to at least 20%, in particular at least 30%, in particular at least 50%, in particular at least 60%, preferably at least 70% of the cavity height h. This applies in analogy to the overlap lengths at the first measuring point M1*a*, at the second measuring point M2*a*, and at the second measuring point M2*b*.

The first rib 13 comprises a first maximum wall thickness mw1. The first maximum wall thickness mw1 is measured in a wall thickness direction 49. The wall thickness direction 49 extends perpendicularly to the transverse direction 50. The wall thickness direction 49 extends parallel to the separation plane 3.

The second rib 23 is arranged at a rib distance a to the first rib 13. The rib distance a is measured in the wall thickness direction 49. In the embodiment, the rib distance a is constant in relation to the transverse direction 50. Independent of the distance in relation to the separation plane 3, the rib distance a is constant. The rib distance amounts to less than the first maximum wall thickness mw1, in particular less than two thirds of the first maximum wall thickness mw1.

The second rib 23 comprises a second maximum wall thickness mw2 measured in the wall thickness direction 49. The second maximum wall thickness mw2 in the embodiment is of the same size as the first maximum wall thickness mw1. However, it can also be provided that the first maximum wall thickness mw1 and the second maximum wall thickness mw1 differ in size.

The rib distance a amounts to at least 10%, in particular at least 20%, of the first maximum wall thickness mw1. It can also be provided that the rib distance a amounts to at least 1%, in particular at least 5%, of the first maximum wall thickness mw1.

The first rib 13 comprises in relation to the second housing shell 20 a first shell distance s1. The first shell distance s1 is measured in transverse direction 50. The first shell distance s1 is measured from the first end 15 of the first rib 13 to the second inner side 28 of the second housing wall 21. The first shell distance s1 is greater than 40% of the first maximum wall thickness mw1 of the first rib 13. This is also illustrated in FIG. 13.

The second rib 23 comprises in relation to the first housing shell 10 a second shell distance s2 (FIG. 16). The second shell distance s2 is measured in transverse direction 50. The second shell distance s2 is measured from the first end 25 of the second rib 23 to the first inner side 18 of the first housing wall 11. The second shell distance s2 is greater than 40% of the second maximum wall thickness mw2 of the second rib 23.

Figure 17:
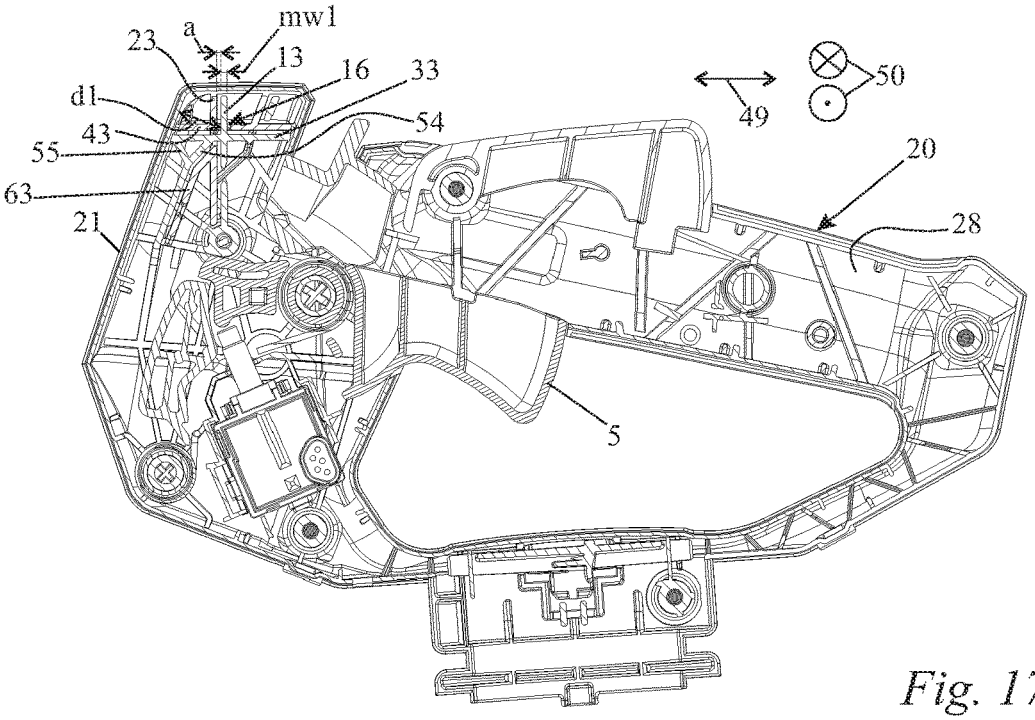
FIG. 17 a section along the section plane XVII-XVII of FIG. 11.

FIG. 17 shows a section through the housing 1 along the section plane XVII-XVII of FIG. 11. Accordingly, the second inner side 28 of the second housing shell 20 with its second ribs 23, 43, and 63 is visible. The first rib 13 projects into the second housing shell 20. The same holds true for the first ribs 33, 53, 54, and 55. These ribs are also illustrated in FIGS. 3 and 4.

Figure 18:
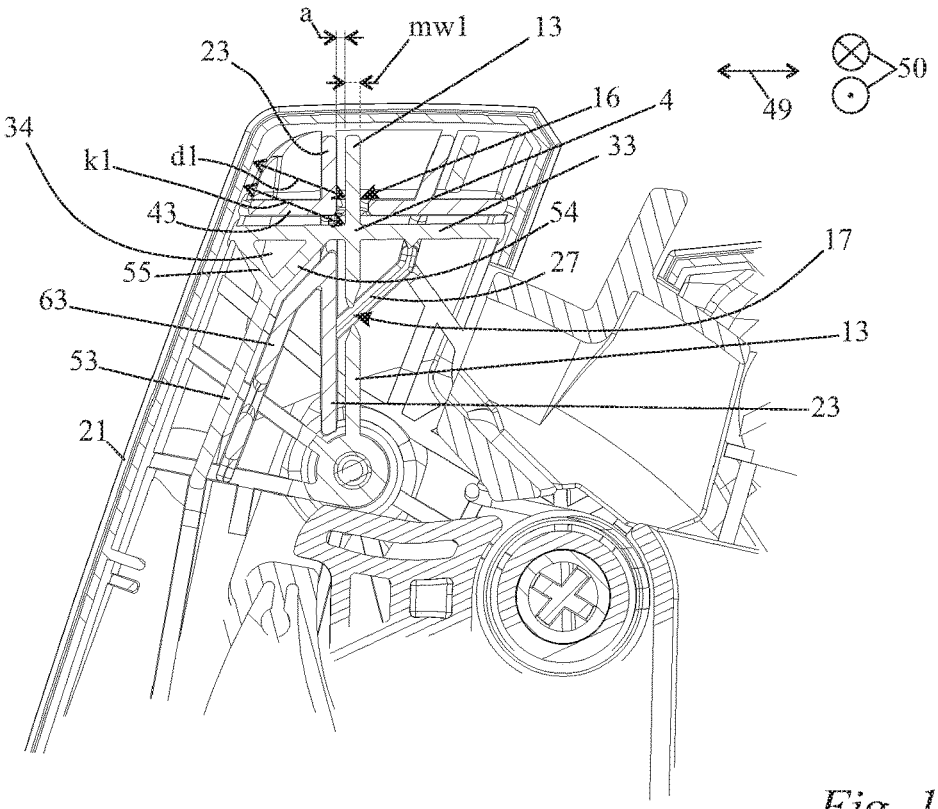
FIG. 18 a detail of the section illustration of FIG. 17.

FIG. 18 shows a detail of the section illustration of FIG. 17. The first rib 13 comprises at least a region 16 which is arranged in relation to the second outer wall 21 at a first distance d1 measured perpendicularly to the transverse direction 50 and perpendicularly to the second outer wall 21. The first distance d1 is measured in the separation plane 3. The first distance d1 amounts to at least five times, in particular at least ten times, the maximum first wall thickness mw1.

In an analogous manner, the second rib 23 comprises a region which is arranged in relation to the first outer wall 11 at a second distance measured perpendicularly to the transverse direction 50 and perpendicularly to the first outer wall 11. The second distance is measured in the separation plane 3. The second distance amounts to at least five times, in particular at least ten times the maximum second wall thickness mw2.

The first housing shell 10 comprises at least two first ribs 13, 33. The at least two first ribs 13 and 33, i.e., the first rib 13 and the first rib 33, comprise in transverse direction 50 a crossing point 4 (FIG. 18). In the crossing point 4, the first rib 13 and the first rib 33 are fixedly connected to each other. In the embodiment, the first rib 13 and the first rib 33 are monolithically configured in the crossing point 4. The at least two first ribs 13 and 33 each extend, beginning at the crossing point 4, perpendicularly to the transverse direction 50 to the first housing wall 11. The crossing point 4 comprises, viewed in transverse direction 50, a cross distance k1 to the first housing wall 11. The cross distance k1 is measured perpendicularly to the transverse direction 50 and perpendicularly to the first housing wall 11. The cross distance amounts to at least five times, in particular at least ten times, the first maximum wall thickness mw1 of the first rib 13.

The first rib 33, the first rib 54, and the first rib 55 form together a structure extending circumferentially closed about the transverse direction 50. The structure comprises three corner points where the first ribs 33, 54, and 55 are connected to each other. The structure encloses a cavity 34.

As illustrated in FIGS. 3 and 17, the first rib 13 comprises a first cutout 17. The first cutout 17 extends in transverse direction 50. The cutout 17 serves for receiving a second reinforcement rib 27 of the second housing shell 20. The reinforcement rib 27 is illustrated in FIGS. 18 and 4. In the assembled state of the housing 1, the second reinforcement rib 27 of the second housing shell 20 projects into the first cutout 17 of the first rib 13 of the first housing shell 10 so that the second reinforcement rib 27 crosses the cutout 17 of the first rib 13 in the direction perpendicular to the transverse direction 50. The second reinforcement rib 27 is arranged exclusively on one side of the separation plane 3. However, it can also be provided that the second reinforcement rib 27 is configured as a second rib and projects past the separation plane 3. It can also be provided that the reinforcement rib 27 comprises a cutout for receiving the first rib 13. The first rib 13 and the reinforcement rib 27 are then inserted into each other in a crossing manner.

Figure 19:
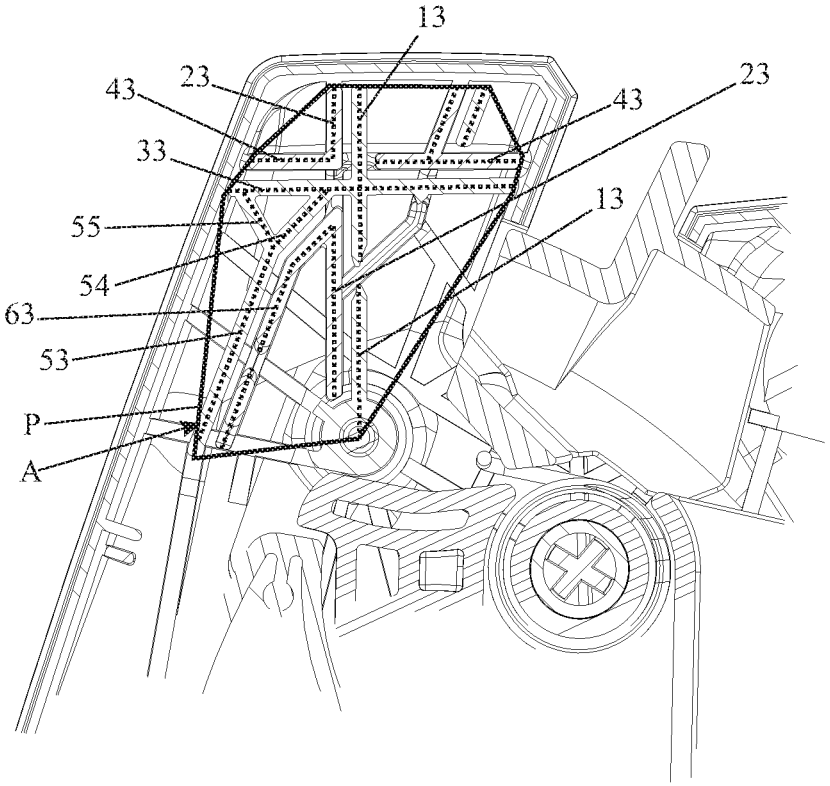
FIG. 19 the detail of FIG. 18 with marking of the first and second ribs.

In FIG. 19, the first ribs of the first housing shell 10 and the second ribs of the second housing shell 20 are marked with dashed lines. All first ribs and all second ribs comprise a total length G which is measured in the separation plane 3 and added up. When adding up, the first ribs and the second ribs are intersected by the separation plane 3 and the length of the first ribs and of the second ribs is measured and added up in the separation plane 3. The length of a rib is measured in this context always in the direction of the greatest extension, viewed from a point of the rib. In case of a curvy or angled extension of the rib in the separation plane 3, the length of the corresponding rib is determined by a path integral.

All first ribs and all second ribs are delimited by a virtual enveloping polygon P. By means of the polygon P, all immediately neighboring end points of first and second ribs in the separation plane 3 are connected to each other by straight lines.

The polygon P encloses a polygon surface P. The quotient of total length G and polygon surface P amounts to at least 0.2 $mm^{-1}$.

What is claimed is:

1. A housing for a hand-guided work implement, the housing comprising:

a first housing shell comprising a first outer wall;

a second housing shell comprising a second outer wall;

wherein the first outer wall and the second outer wall at least partially contact each other along a separation plane;

wherein the first housing shell comprises a first rib extending in a transverse direction transversely to the separation plane;

wherein the first rib projects past the separation plane into the second housing shell;

wherein first measuring points are located in the separation plane;

wherein the first rib comprises a first rib height measured in the transverse direction, beginning at one of the first measuring points located in the separation plane, to a first end of the first rib, wherein the first end of the first rib faces the second housing shell;

wherein the second housing shell comprises a second shell height measured in the transverse direction, beginning at the same first measuring point located in the separation plane where the first rib height is measured, to a second inner side of the second housing shell, wherein the second inner side faces the first housing shell;

wherein the first measuring points located in the separation plane include at least one first measuring point at which the first rib height amounts to at least 15% of the second shell height;

wherein the second housing shell comprises a second rib, wherein the second rib, beginning at the second outer wall of the second housing shell, extends in the transverse direction toward the first housing shell, wherein the second rib projects past the separation plane, and wherein the second rib projects into the first housing shell.

2. The housing according to claim 1, wherein second measuring points are located in the separation plane, wherein the second rib comprises a second rib height measured in the transverse direction, beginning at one of the second measuring points located in the separation plane, to a second end of the second rib, wherein the second end of the second rib faces the first housing shell, wherein the first housing shell comprises a first shell height measured in the transverse direction, beginning at the same second measuring point located in the separation plane where the second rib height is measured, to a first inner side of the first housing shell, wherein the first inner side of the first housing shell faces the second housing shell, and wherein the second measuring points located in the separation plane include at least one second measuring point at which the second rib height amounts to at least 15% of the first shell height.

3. The housing according to claim 1, wherein the first rib comprises a first maximum wall thickness measured perpendicularly to the transverse direction in a wall thickness direction and wherein a rib distance measured in the wall thickness direction between the first rib and the second rib amounts to less than the first maximum wall thickness.

4. The housing according to claim 3, wherein the rib distance amounts to at least 1% of the first maximum wall thickness.

5. The housing according to claim 1, wherein the first rib comprises a first region arranged in relation to the second outer wall at a first distance measured in the separation plane perpendicularly to the second outer wall.

6. The housing according to claim 1, wherein the first rib is fixed at the first outer wall.

7. The housing according to claim 6, wherein the first rib is embodied monolithic with the first outer wall.

8. The housing according to claim 1, wherein the first rib comprises a first maximum wall thickness measured perpendicularly to the transverse direction in a wall thickness direction, wherein the first rib comprises a first shell distance in relation to the second housing shell measured in the transverse direction, and wherein the first shell distance is greater than 40% of the first maximum wall thickness of the first rib.

9. The housing according to claim 1, wherein the first housing shell comprises two of the first rib and wherein said two first ribs cross each other and comprise a crossing point, viewed in the transverse direction.

10. The housing according to claim 9, wherein the crossing point, viewed in the transverse direction, comprises a first cross distance in relation to the first housing wall, and wherein said two first ribs, beginning at the crossing point, extend up to the first housing wall.

11. The housing according to claim 1, wherein the first housing shell comprises a plurality of the first rib, wherein the second housing shell comprises a plurality of the second rib, wherein the plurality of the first rib and the plurality of the second rib comprise an added-up total length measured in the separation plane, wherein the plurality of the first rib and the plurality of the second rib are delimited in the separation plane by a virtual enveloping polygon, wherein the virtual enveloping polygon encloses a polygon surface, and wherein a quotient of the added-up total length and the polygon surface amounts to at least 0.2 $mm^{-1}$.

12. The housing according to claim 1, wherein the first rib comprises a first cutout, wherein the second housing shell comprises a second reinforcement rib projecting in the transverse direction into the first cutout so that the second reinforcement rib crosses the cutout of the first rib in a direction perpendicularly to the transverse direction.

13. The housing according to claim 1, wherein the first housing shell and the second housing shell are injection molded parts.

14. The housing according to claim 1, wherein the housing is a grip housing and wherein an operating element for operating the work implement is arranged at the grip housing.

15. The housing according to claim 1, wherein the first rib intersects the separation plane across an added-up first length and wherein the first rib height at the first measuring points located in the separation plane across at least half of the added-up first length of the first rib amounts to at least 30% of the second shell height.

* * * * *